US005632088A

United States Patent [19]

Naso et al.

[11] Patent Number: 5,632,088

[45] Date of Patent: May 27, 1997

[54] CABLE STRIPPER DEVICE

[76] Inventors: Dan Naso, 18132 Fraser Hwy., Surrey, British Columbia, Canada, V3S 8E7; Lyle D. Sieg, 7690 Vantage Way, RR5 Delta, British Columbia, Canada, V4G 1A7

[21] Appl. No.: 450,799

[22] Filed: May 25, 1995

[51] Int. Cl.[6] ..... H02G 1/12

[52] U.S. Cl. ..... 30/91.2; 30/90.1

[58] Field of Search ..... 30/90.1, 90.4, 30/90.6, 90.7, 90.8, 91.1, 91.2; 83/947; 81/9.4, 9.44, 9.51

[56] References Cited

U.S. PATENT DOCUMENTS

| | | | |
|---|---|---|---|
| 1,801,706 | 4/1931 | Westfall | 30/91.1 |
| 2,187,215 | 1/1940 | Spinello | 30/90.6 |
| 2,385,368 | 9/1945 | Montgomery | 30/91 |
| 2,695,537 | 11/1954 | Imman et al. | 81/9.5 |
| 2,787,177 | 4/1957 | Frye | 30/91.2 |
| 3,161,088 | 12/1964 | Tolman | 81/9.5 |
| 3,628,402 | 12/1971 | Staiger | 81/9.44 |
| 4,117,749 | 10/1978 | Economu | 30/90.6 |
| 4,426,778 | 1/1984 | Christie | 30/90.1 |
| 4,543,717 | 10/1985 | Luka | 30/90.1 X |
| 4,858,315 | 8/1989 | Tanner | 81/9.44 X |
| 5,347,777 | 9/1994 | Sudduth | 52/223.13 |

*Primary Examiner*—Eugenia Jones
*Attorney, Agent, or Firm*—Brian M. Long

[57] ABSTRACT

A cable stripper for use with a cable anchor has an elongate cutter on a tubular body, the cutter having at one end thereof, an inwardly projecting transverse cutter blade. The cutter and the tubular body are connected so as to allow the cutter to move relative to the tubular body, which is insertable into said passage in the cable anchor, with the cable extending through the tubular body, so as to cause the frusto-conical internal surface to wedge the cutter blade into penetrating engagement with a sheath on the cable.

7 Claims, 4 Drawing Sheets

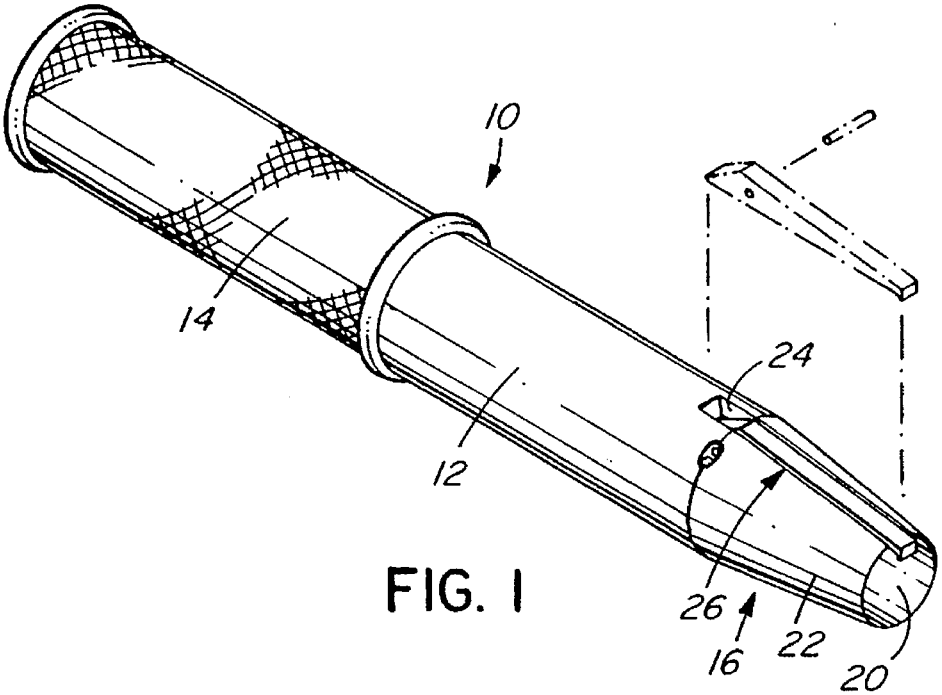
FIG. 1
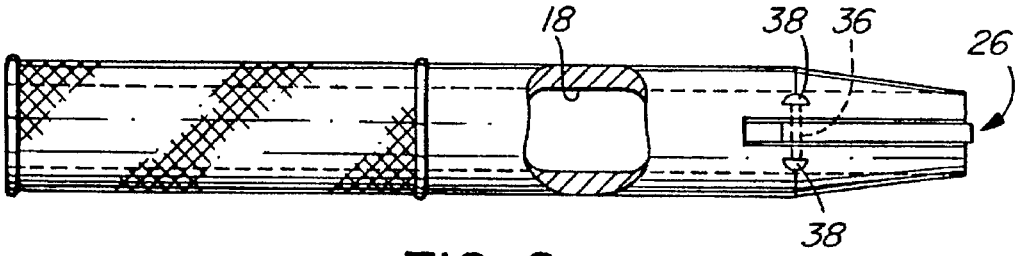
FIG. 2
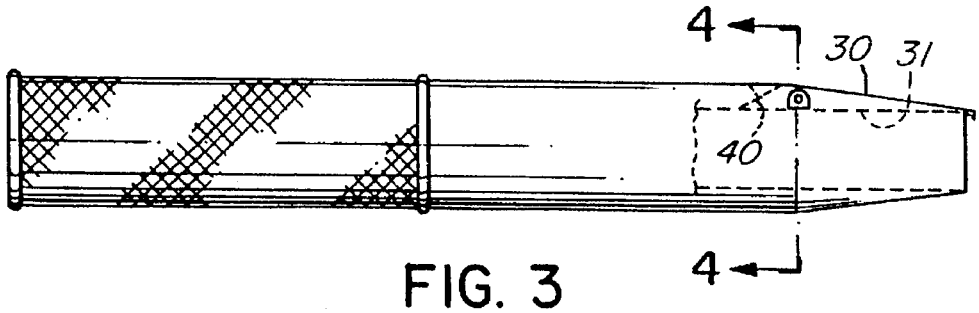
FIG. 3
FIG. 4
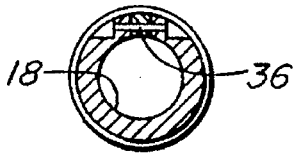

CABLE STRIPPER DEVICE

BACKGROUND OF THE INVENTION

1. Field of the Invention

The present invention relates to cable strippers for use with cable anchors for use in post tensioning concrete structures, for stripping cable sheath from end portions of cables which are to be secured by the cable anchors. The present invention also relates to a method of stripping a sheath from an end portion of a cable.

2. Description of the Related Art

For use in post tensioning a concrete structure, it is known to insert an end of a cable, usually referred to as a "tendon", into a passage extending through a cable anchor, and then to secure the cable to the cable anchor, for example by means of wedges inserted into the passage into engagement with the cable.

Before the insertion of the wedges, it is necessary to strip the sheath from the end portion of the cable.

Various cable strippers have been previously proposed for stripping a sheath from a cable. Examples of such strippers are disclosed, for example, in U.S. Pat. Nos. 3,161,088; 2,385,368 and 2,695,537. For post tension cables the sheathing is currently being stripped by simply using a knife before inserting the cable through anchor.

In U.S. Pat. No. 4,426,778, there is disclosed a device for stripping wires and cables which has a single point knife blade mounted on a lever arm on a tubular tool body having an axial passage for receiving the wire or cable. The knife blade is resiliently biased into cutting contact with the cable, and the tool can be rotated about the cable to cause the knife blade to cut the sheath around the cable.

It is, however, a disadvantage of this prior device that the lever arm must be actuated manually in order to withdraw the knife blade from the axial passage, to allow insertion of the cable through the tool body. Consequently, the position, along the length of the cable, at which the cut is made is variably determined by the manual actuation of the lever arm.

BRIEF SUMMARY OF THE INVENTION

According to the present invention, a cable stripper has a tubular body with a cylindrical passage extending therethrough and a tapered end portion having a frusto-conical external surface. An elongate cutter is provided in a slot extending longitudinally of the end portion and has, at one end thereof, a transverse cutter blade.

The present cable stripper is used in conjunction with a cable anchor, which has a passage therethrough for receiving the end portion of the cable. The passages formed with a frusto-conical internal surface, which is complementary to the frusto-conical external surface of the tapered end portion of the tubular body. By insertion of the tapered end portion of the tubular body into the passage in the cable anchor, the cutter is deflected, by engagement with the frusto-conical internal surface on the cable anchor, and is thereby wedged into penetrating engagement with the cable sheath. Then, by rotating the tubular body about the cable, the cable sheath can be cut around the cable, thus allowing an end portion of the sheath to be pulled longitudinally from the end portion of the cable.

In this way, it can be ensured that the cutting of the cable sheath is effected at a predetermined location, relative to the cable anchor, without any necessity for longitudinally adjusting the cable in position through the cable anchor so as to correct the location of the bared portion of the cable.

BRIEF DESCRIPTION OF THE DRAWINGS

The invention will be more readily understood from the following description thereof when taken in conjunction with the accompanying drawings, in which:

FIG. 1 shows a view in perspective of a cable stripper according to the present invention;

FIG. 2 shows a plan view, partly broken-away in section, of the cable stripper of FIG. 1;

FIG. 3 shows a view in side elevation of the cable stripper of FIG. 1;

FIG. 4 shows a view taken in cross-section along the line 4—4 of FIG. 3;

DESCRIPTION OF THE PREFERRED EMBODIMENT

Figure 5:
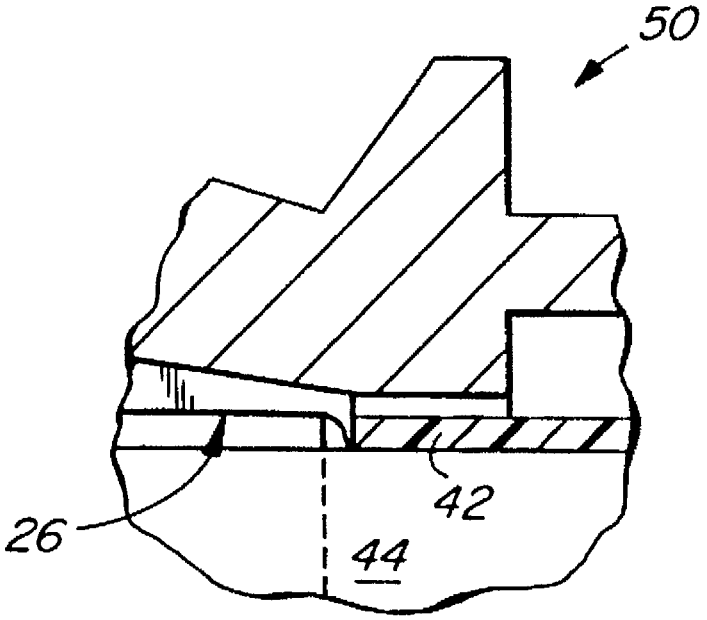
FIG. 5 shows a broken-away view taken in longitudinal cross-section through part of the cable stripper of FIGS. 1 through 4.

In FIGS. 1 through 4 of the accompanying drawings, there is shown a cable stripper indicated generally by reference numeral 10, which has a tubular body 12 formed, at one end thereof, with a knurled handgrip 14 and, at the other end thereof, with a tapered end portion indicated generally by reference numeral 16. A cylindrical passage 18, which is co-axial with the tubular body 12, extends longitudinally through the tubular body 12 and has an end 20 at the tapered end portion 16 of the tubular body 12.

The tapered end portion 16 has a frusto-conical external surface 22, which is converges with the cylindrical passage 18 at the passage end 20.

The tapered end portion 16 is also formed with a longitudinal slot 24, which extends through the entire wall thickness of the tubular body 12 between the passage 18 and the external frusto-conical surface 22, and which also extends longitudinally the entire length of the tapered end portion 16.

A cutter indicated generally by reference numeral 26 is received in the slot 24. The cutter 26 has an elongate shape and is formed, at one end thereof, with a transverse cutter blade 28, which projects radially inwardly from the cutter 26, relative to the longitudinal axis (not shown) of the tubular body 12. As can be seen in FIGS. 1 through 3, the cutter 26 projects slightly beyond the end 20 of the cylindrical passage 18 and, thus, beyond the tapered end portion 22 of the tubular body 12.

Figure 6:
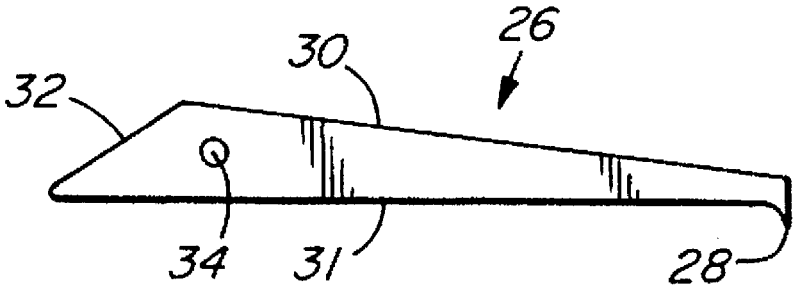
FIG. 6 shows a view in side elevation of cutter forming part of the cable stripper of FIGS. 1 through 4.
Figure 8:
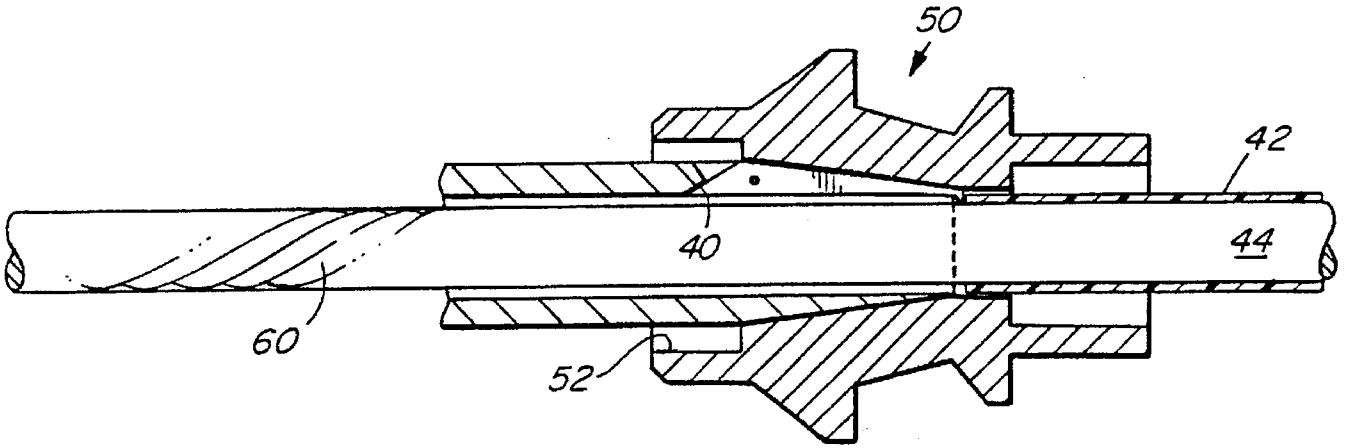
FIG. 8 shows a view corresponding to FIG. 7 but with the stripper fully inserted into the cable anchor.

As can be seen in FIG. 6, the cutter 26 has a flat outer surface 30 and a flat longitudinal inner surface 31, which converge along the length of the cutter 26 towards the cutter blade 28. More particularly, the cutter 26 tapers towards the cutter blade 28, in longitudinal radial cross-section, in conformity with the slot 24, as shown in FIGS. 3 and 8. At its end opposite from the cutter blade 28, the cutter 26 has a flat inclined face 32 extending from the surface 30 to the surface 31. The cutter 26 is also formed, in the vicinity of the inclined face 32, with a cylindrical transverse opening 34, which receives a pivot pin 36 (FIG. 2) for pivotally connecting the cutter 26 to the tubular body 12. The pivot pin 36 is received in corresponding cylindrical openings formed in the tubular body 12 and extending, transversely of the slot 24, from notches 38 formed at opposite sides of the slot 24 in the exterior of the tubular body 12.

Figure 7:
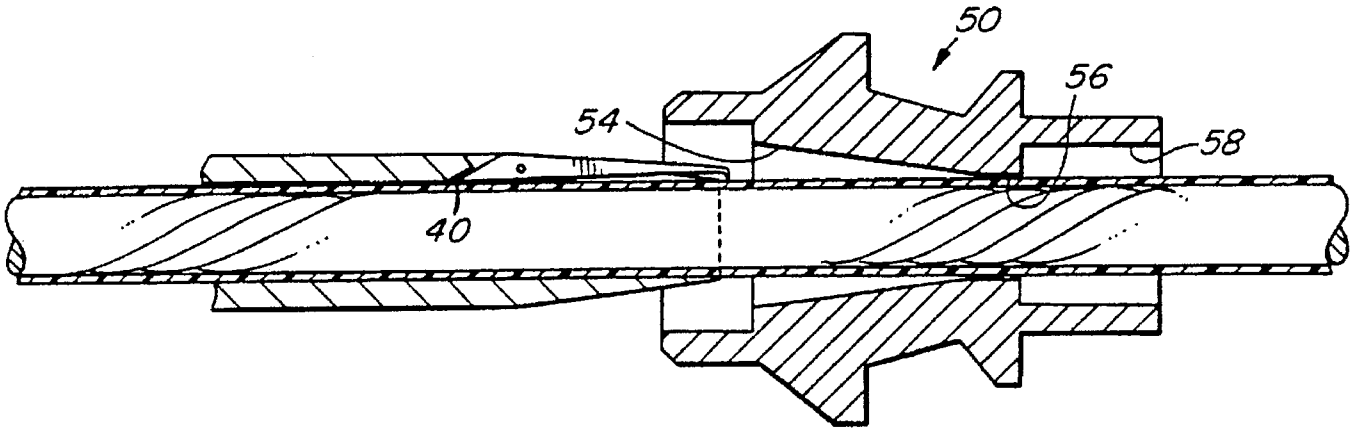
FIG. 7 shows a portion of the cable stripper of FIGS. 1 through 4 being inserted into a cable anchor.

At the end of the slot 24 remote from the passage end 20, the tubular body 12 is formed with an inclined surface 40 (FIGS. 3, 7 and 8), which serves as an abutment surface for engaging the inclined face 32 of the cutter 26 and, thereby, limiting the pivotation of the cutter 26 and the cutter blade 28 about the pivot pin 36 in a clockwise direction, as viewed in FIGS. 3, 7 and 8. The pivotation of the cutter 26 in this direction is therefore limited to an operative position, in which the cutter 26 is shown in FIGS. 3 and 8, and in which the cutter blade 28 penetrates through the entire thickness of a plastic sheath 42 provided on a cable 44. In this operative position of the cutter 26, the cutter surface 30 is flush with opposite outermost longitudinal edges of the slot 24.

The above-described cable stripper 10 is for use with a cable anchor indicated generally by reference numeral 50 in FIGS. 7 and 8.

The cable anchor 50 is formed with a passage for receiving the cable 44, and this passage comprises a cylindrical end portion 52, a portion having a frusto-conical internal surface 54, which converges in a direction extending away from the cylindrical portion 52, and two further cylindrical portions 56 and 58.

The frusto-conical internal surface 54 of the cable anchor 50 is complementary to that of the frusto-conical external surface 22 of the end portion 16 of the tubular body 12, so that the frusto-conical surfaces 22 and 54 can mate snugly as shown in FIG. 8.

To strip an end portion 60 of the cable 44, after the cable 44 has been inserted through the cable anchor 58 from the right to the left as viewed in FIG. 7, the cable stripper 10 is pushed longitudinally onto the cable 44, so that the cable 44 extends through the cylindrical passage 18 through the tubular body 12, as shown in FIG. 7. During this relative movement of the cable stripper 10 and the cable 44, the cutter blade 28 can slide along the external surface of the cable sheath 42, as shown in FIG. 7, or the inclined surface 32 can be manually depressed so as to raise the cutter blade 28 from the surface of the sheath 42.

As the cable stripper 10 is advanced into the cable anchor 50 so that the frusto-conical surface 22 approaches the frusto-conical surface 54 of the cable anchor 50, the leading end of the cutter 26, at which the cutter blade 28 is provided, meets and slides along the frusto-conical surface 54. This causes the cutter 26 to be pivoted slightly about the pivot pin 36 and, thus, wedges the cutter blade 28 inwardly into an operative position, in which it is shown in FIGS. 3 and 8, so that the cutter blade 28 penetrates the cable sheath 42, as illustrated in FIG. 8. The cutter blade 28 is dimensioned such that it cuts through the cable sheath 42 without penetrating, to any substantial extent, into the strands of the cable 44.

As can be seen from FIG. 8, the slot 24 has a shape, taken in longitudinal cross-section radially of the tubular body, which is similar to the corresponding shape of the cutter 26. The cutter 26 is therefore received wholly within the slot 24, except for the end portion of the cutter 26 projecting beyond the tapered end portion 22, when the cutter 26 is in its operative position. The cutter 26 is thus radially within the confines of the slot 24 when in its operative position.

The cable stripper 10 is then manually rotated around the cable 44, so that the cutter blade 28 forms a circular cut extending completely around the cable 44 and, thus, severs the cable sheath 42, an end portion of which can then be withdrawn to the left, as viewed in FIG. 8, from the cable 44. In this way, the cutting of the cable sheath 42 is effected at a predetermined position along the length of the cable 44, relative to the cable anchor 50.

Figure 9:
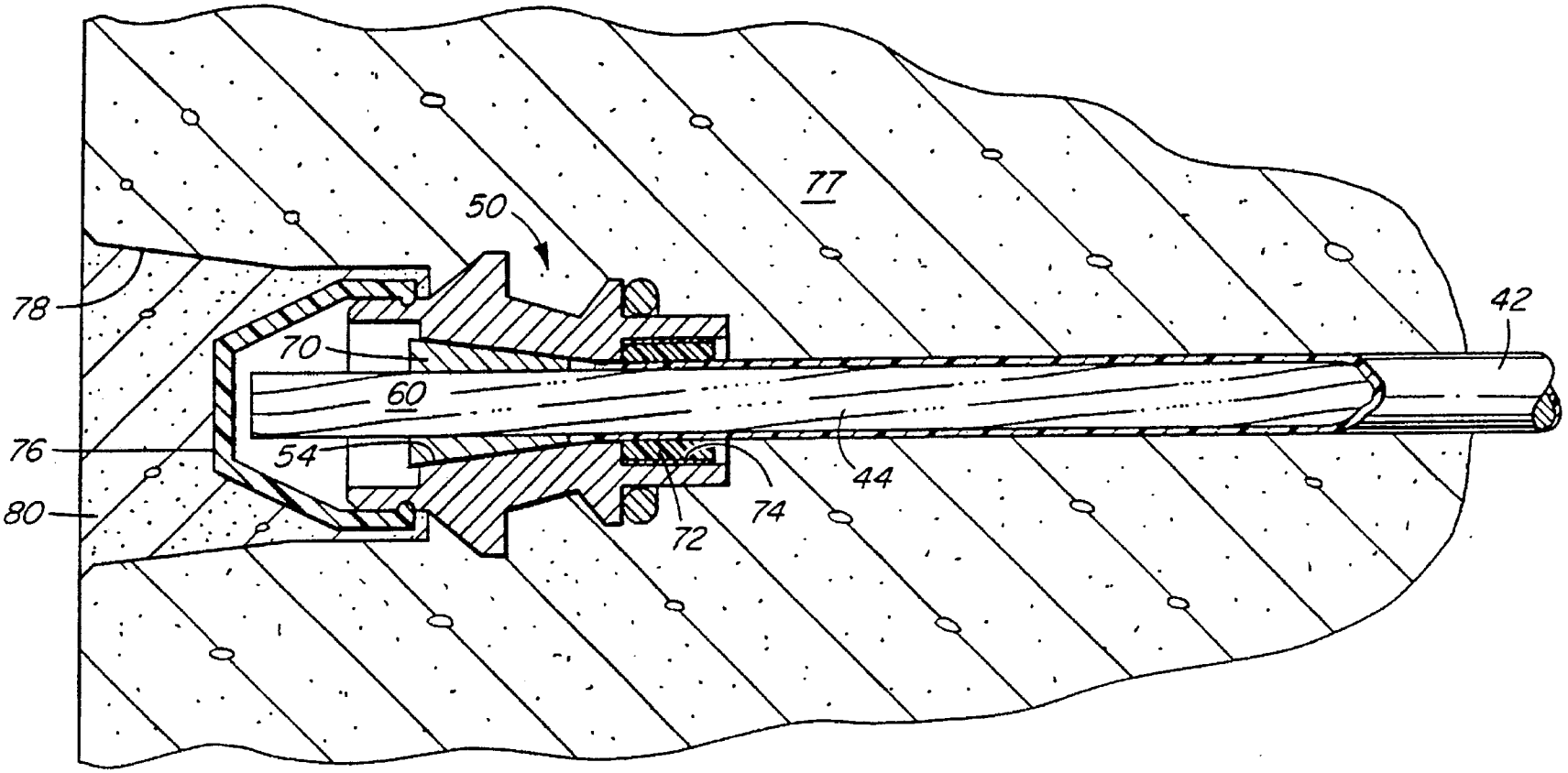
FIG. 9 shows a view in longitudinal cross-section through an installed assembly including this cable anchor of FIGS. 7 and 8.

FIG. 9 shows the anchor 50, when in use, secured to the cable 44 by mens of wedges 70 inserted into wedging engagement with the frusto-conical surface 54 of the cable anchor 50 and with the stripped end portion 60 of the cable 44. An annular seal 72 is provided in the cylindrical passage portion 58 and secured by adhesive 74, and an end cap 76 encloses the end of the cable 42 and is secured to the cable anchor 50. The cable 44 and the cable anchor 50 are embedded in concrete 77, which is formed with a recess 78 which contains the end cap 76 and is filled with a grout 80.

As will be apparent to those skilled in the art, whereas modifications may be made in the above-described cable stripper and anchor device within the scope of the invention as defined by the appended claims.

We claim:

1. A cable stripper, comprising:

a tubular body;

said tubular body having a tapered end portion and a cylindrical passage extending through said tapered end portion;

said cylindrical passage having a first end at said tapered end portion; and said tapered end portion having a frusto-conical external surface which converges towards said first end of said cylindrical passage;

a slot formed in and extending longitudinally of said tapered end portion;

an elongate cutter in said slot;

said elongate cutter having, at one end thereof, a cutter blade extending transversely of said elongate tuner and projecting radially inwardly of said tubular body; and a connection between said cutter and said tubular body allowing said cutter to move radially inwardly to within the confines of said slot, into an operative position, so as to cause said cutter blade to penetrate a sheath on the cable;

said cutter having an outer longitudinal surface inclined inwardly of said tubular body along said tapered end portion towards said first end of said cylindrical passage to allow wedging of said cutter into said operative position on insertion of said end portion into a frusto-conical recess in a cable anchor.

2. A cable stripper as claimed in claim 1, wherein said outer longitudinal surface of said cutter is flush with opposite edges of said slot when said cutter is in said operative position.

3. A cable stripper as claimed in claim 1, wherein said connection is formed by a pivot connecting said cutter pivotably to said tubular body.

4. A cable stripper as claimed in claim 1, wherein said tubular body is formed with an abutment engageable with said cutter to prevent said cutter from moving radially inwardly beyond said operative position.

5. A cable stripper as claimed in claim 1, wherein said cutter has a longitudinal cross-sectional shape, taken radially of said tubular body, which is similar to that of said slot.

6. A cable stripper as claimed in claim 1, wherein said cutter blade projects beyond said first end of said cylindrical passage.

7. A cable stripper as claimed in claim 1, wherein said external surface of said tapered portion extends to said cylindrical passage at said first end of said cylindrical passage.

* * * * *